US006913298B2

(12) United States Patent
Inoue

(10) Patent No.: US 6,913,298 B2
(45) Date of Patent: Jul. 5, 2005

(54) ANTI-PANIC MECHANISM OF VEHICLE DOOR LATCH DEVICE

(75) Inventor: Jiro Inoue, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/734,591

(22) Filed: Dec. 15, 2003

(65) Prior Publication Data

US 2004/0174022 A1 Sep. 9, 2004

(30) Foreign Application Priority Data

Dec. 13, 2002 (JP) ..... 2002-362688

(51) Int. Cl.[7] ..... E05C 3/06
(52) U.S. Cl. ..... 292/216; 292/201
(58) Field of Search ..... 292/216, 201, 292/DIG. 23; 70/277

(56) References Cited

U.S. PATENT DOCUMENTS 5,106,135 A * 4/1992 Menke et al. ..... 292/216
6,126,212 A * 10/2000 Fujihara ..... 292/216
6,554,329 B1 * 4/2003 DeBlock et al. ..... 292/216

FOREIGN PATENT DOCUMENTS

| | | |
|---|---|---|
| GB | 2 357 548 A | 8/2001 |
| JP | 58 101949 | 7/1983 |
| JP | 11-141211 | 5/1999 |
| JP | 11-324451 | 11/1999 |

* cited by examiner

*Primary Examiner*—Gary Estremsky
(74) *Attorney, Agent, or Firm*—Browdy and Neimark, P.L.L.C.

(57) ABSTRACT

An anti-panic mechanism comprises a lock lever displaceable between an unlocked position and a locked position, an over center spring urging the lock lever to either side of the unlocked position and locked position with a dead point, an open link displaceable between an engaging position and a non-engaging position, an output member displacing the lock lever by a motor, an anti-panic spring urging the open link toward the engaging position from the non-engaging position, a connecting lever connecting the open link to the lock lever. The connecting lever releases the open link before the lock lever crosses over the dead point of the over center spring when the output member is rotated in the unlocking direction.

5 Claims, 4 Drawing Sheets

ANTI-PANIC MECHANISM OF VEHICLE DOOR LATCH DEVICE

BACKGROUND OF THE INVENTION

1. Field of the Invention

The present invention relates to an anti-panic mechanism of a vehicle door latch device.

2. Description of the Related Art

In the conventional prevailing vehicle door latch devices, unlocking operations by an inside lock button, a remote control transmitter and the like are not normally completed if the outside open handle of a door is in the state of being manipulated by an opening operation, nor is it possible to open the door. Such a state is referred to as a panic state in the industry. When plunged into the panic state, the outside open handle is restored to a non-operation state and, then, the unlocking operation is performed again by the central door lock system and the like and, after that, the opening operation of the door handle is performed again, so that the door is opened. That is, two unlocking operations and two door opening operations are required until the door is opened. Thus, in the present invention, a state, in which two unlocking operations and two door opening operations are required, is defined as a full panic state.

A door latch device comprising an anti-panic mechanism to reduce a complication of operations due to the occurrence of the full panic is also known (Japanese Utility Model Application Laid-Open No. 58-101949 and Japanese Patent Application Laid-Open No. 11-324451). The prior antic-panic mechanism is a mechanism aiming to eliminate the second unlocking operation. In the prior art device, in the case where the first unlocking operation is not normally completed by the first opening operation of the door handle, a shifting to the unlocked state is completed when the door handle is restored to the non-operation state. Hence, when the second opening operation of the door handle is subsequently performed, it is possible to open the door even if the second unlocking operation is not performed. Thus, the state, in which single unlocking operation and two opening operation are required, is defined as a semi-panic state as against the full panic state.

The above described two types of panic states occur when the shifting to the locked state from the unlocked state of the door latch device falls behind the opening operation by the outside door handle.

For example, even after the unlocking operation was performed by the remote control transmitter, the central door lock system, the smart entry mechanism as described in Japanese Patent Application Laid-Open No. 11-141211, the panic state occurs when the opening operation is performed by the outside door handle before the shifting to the unlocked state from the locked state of the door latch device is completed.

Here, the completion of the shifting to the unlocked state from the locked state can be regarded as corresponding to the timing in which a lock lever of the door latch device crosses over a dead point of an over center spring arranged between the unlocked position and the locked position. Therefore, even after the unlocking operation was performed by the switch of the central door lock and the like, the panic state occurs when the outside door handle is manipulated before the lock lever crosses over the dead point by the motor power. Since such a timing of the panic state occurrence is common to the conventional door latch devices regardless of the presence or absence of the anti-panic mechanism, the conventional anti-panic mechanism has been such that it is not possible to reduce the frequency of occurrences even if it can change the types of the panic states from the full panic state to the semi panic state.

However, it is possible to obtain a substantial unlocked state by the motor power at an early stage before the lock lever crosses over the dead point of the over center spring so as to make the door opening operation effective, and the frequency of occurrences of the panic state can be reduced.

SUMMARY OF THE INVENTION

It is an object of the present invention to provide an improved anti-panic mechanism of a vehicle door latch device in which the frequency of occurrences of the panic state can be reduced.

DESCRIPTION OF THE PREFERRED EMBODIMENT

Figure 1:
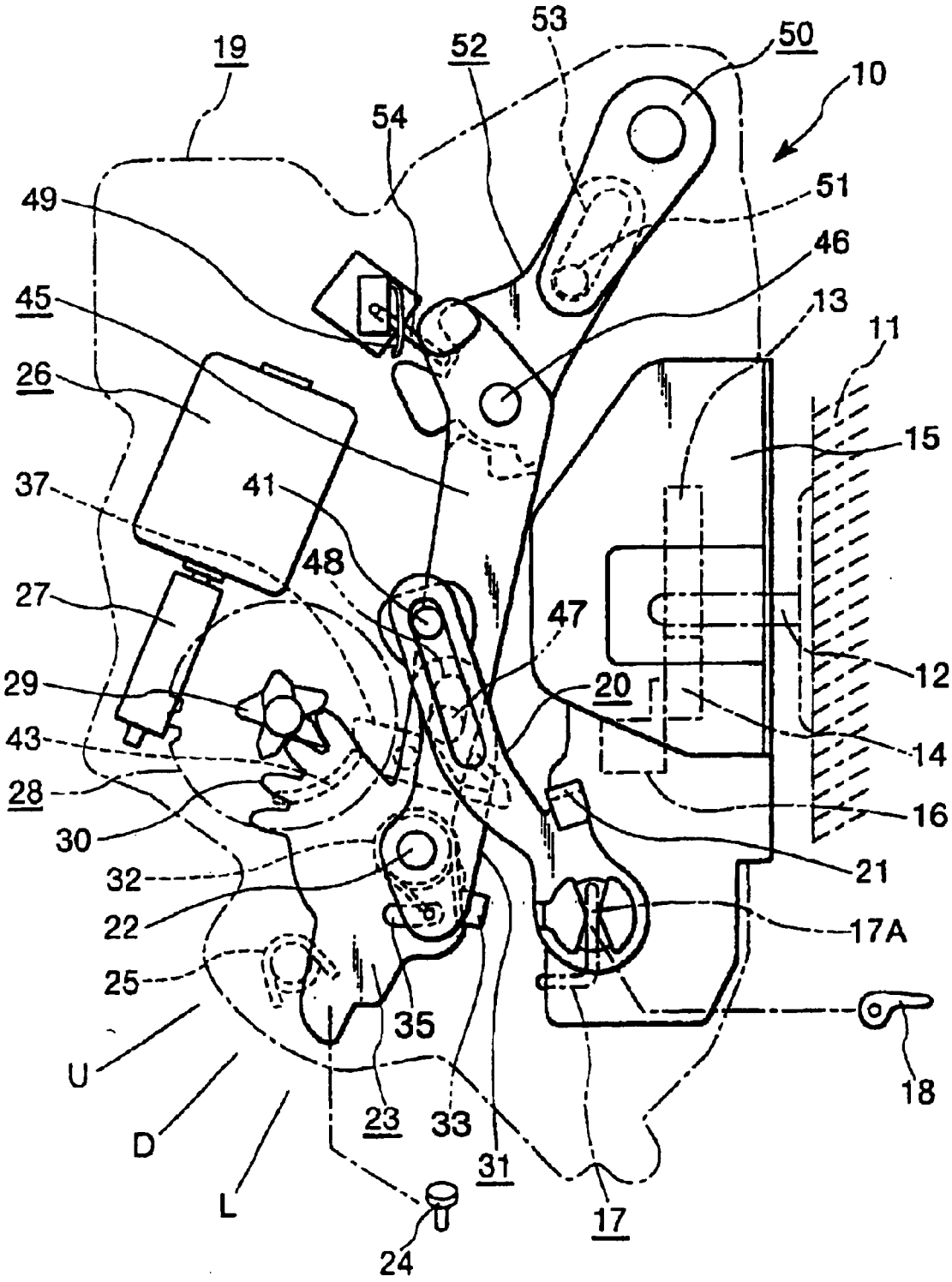
FIG. 1 is an interior side view of a door latch device provided with an anti-panic mechanism according to the prevent invention.

FIG. 1 shows an interior side view of a door latch device according to the present invention. The door latch device is constituted by a latch assembly 10 to be mounted on a door (not shown) and a striker 12 to be fixed to a vehicle body 11. The latch assembly 10 has a latch 13 engageable with the striker 12 when the door is closed, and a ratchet 14 engageable with the latch 13 so as to hold an engagement with the latch 13 and the striker 12. The latch 13 and the ratchet 14 are pivotally mounted on the front side of a latch body 15 by shafts (not shown) extending in a back-and-forth direction of the latch body 15. The ratchet 14 has a pin 16 which is engageable with an abutting portion 21 of an open link 20. In FIG. 1, when the ratchet pin 16 moves upward, the latch 13 is released from ratchet 14, thereby the door is opened.

An open lever 17 is pivotally mounted on the rear side of the latch body 15 by shaft (not shown) extending in the front-and-back direction of the latch body 15. The open lever 17 is operatively connected to an outside open handle 18 of the door. When the outside open handle 18 is operated to open the door, an interior side portion 17A of the open lever 17 moves upward in FIG. 1.

Figure 10:
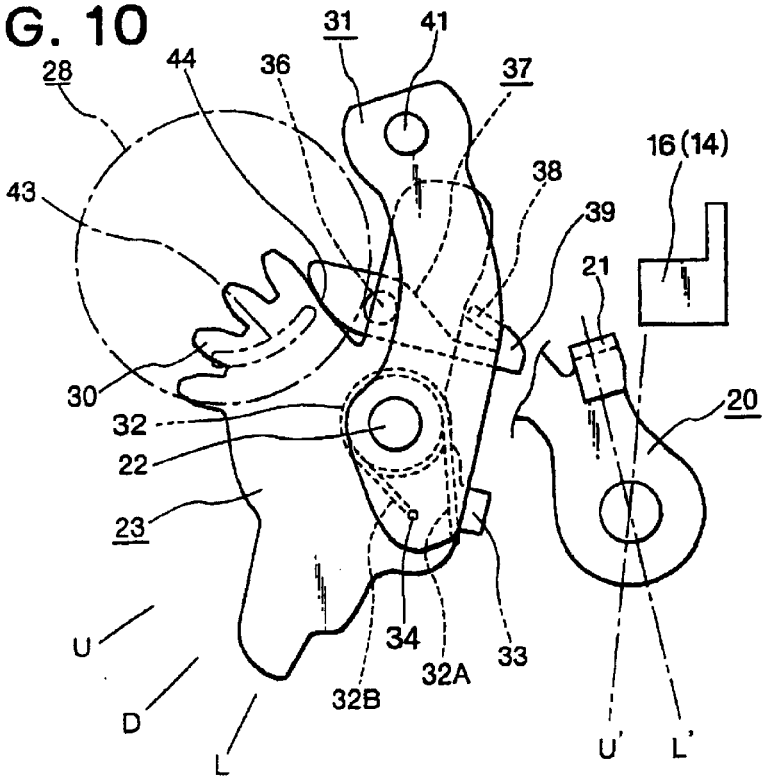
FIG. 10 is an explanatory view of the action of a locked state.
Figure 11:
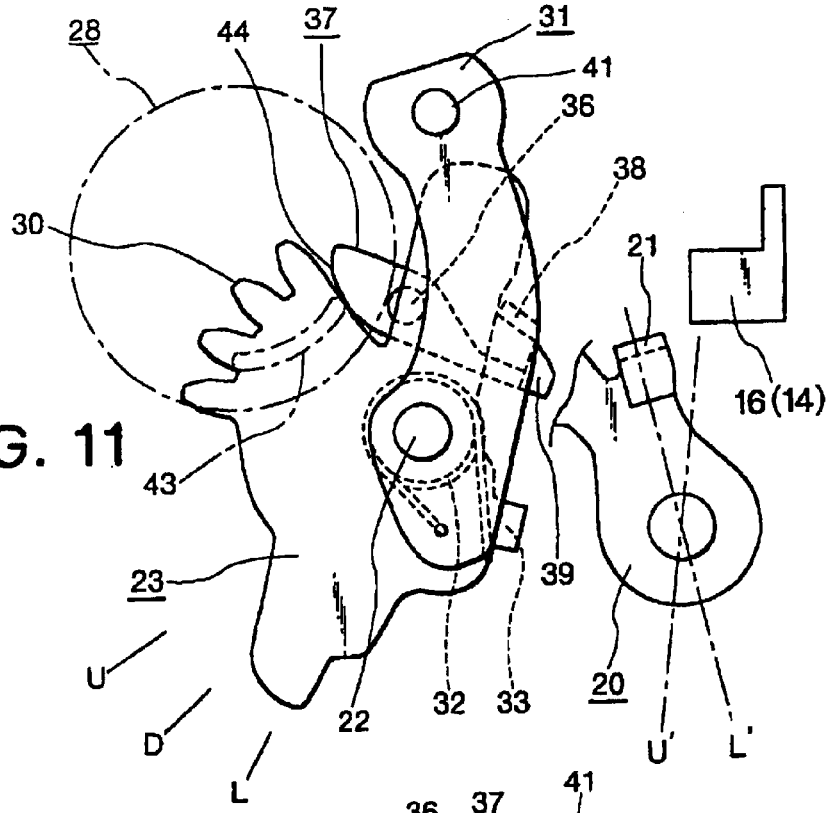
FIG. 11 is an explanatory view of an action when a hook of the connecting lever is detached from a protrusion of the intermediate lever by an unlocking rotation of the output member.

A resin case 19 extending backward is fixed to the interior side portion of the latch body 15. The interior side portion 17A of the open lever 17 is positioned inside the resin case 19. An open link 20 (FIG. 3) extending an up-and-down direction is provided in the inside of the resin case 19. A lower portion of the open link 20 is connected to the interior side portion 17A of the open lever 17. When the interior side portion 17A moves upward by the door opening operation of the open handle 18, the open link 20 moves upward from a standby position (FIGS. 1 and 2) to an actuated position. In addition, the upper portion of the open link 20 is movable in the back-and-forth direction about the lower portion thereof as a center, and displaceable between an engaging position U' (FIGS. 2 and 12) and a non-engaging position L' (FIGS. 1, 10 and 11).

Figure 2:
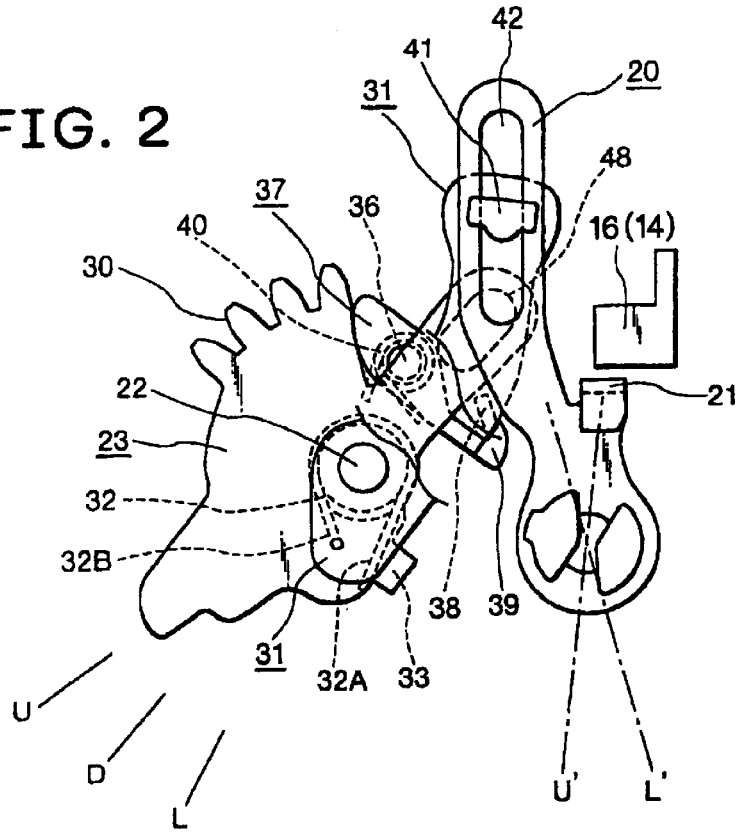
FIG. 2 is an enlarged view of the anti-panic mechanism in an unlocked state.
Figure 3:
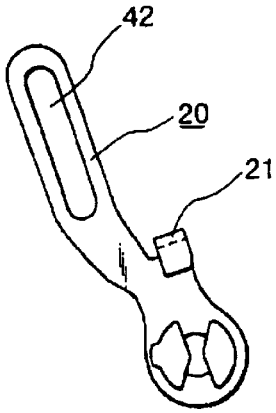
FIG. 3 is an interior side view of an open link.
Figure 12:
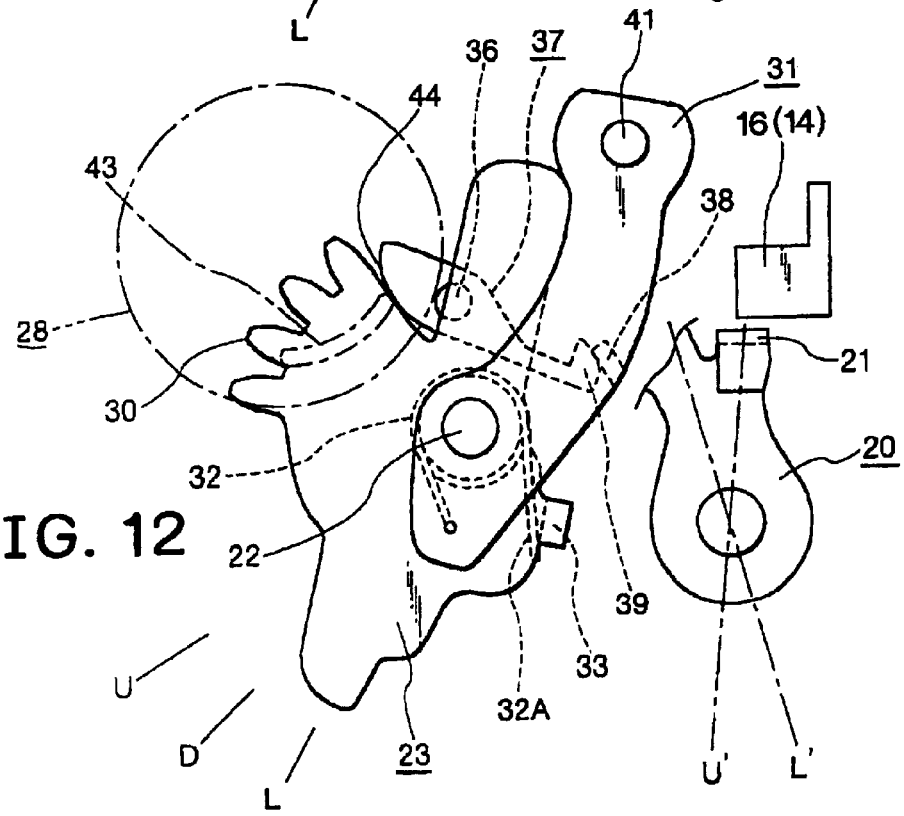
FIG. 12 is an explanatory view of the action when the open link moves to an engaging position due to the action of an anti-panic spring, while the lock lever continues to stay at a locked position.

The abutting portion 21 of the open link 20 is arranged in facing relationship with the ratchet pin 16 in the up-and-down direction when the open link 20 is in the engaging position U' as shown in FIGS. 2 and 12. In this state, when the open link 20 moves upward toward the actuated position by the rotation of the open lever 17, the abutting portion 21 comes into contact with the ratchet pin 16 to push it upward, thereby the ratchet 14 is released from the latch 13 so as to open the door. On the contrary, when the open link 20 is in the non-engaging position L', the abutting portion 21 moves away from the ratchet pin 16. Thus, even when the open link 20 moves upward, the abutting portion 21 can not push the ratchet pin 16 upward, thereby making it not possible to open the door.

Figure 4:
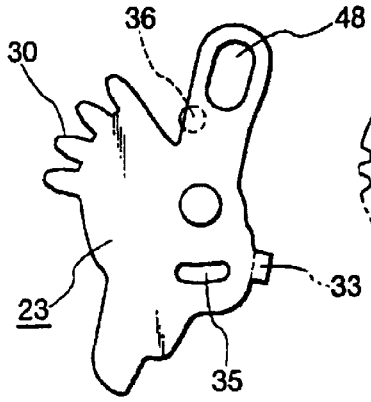
FIG. 4 is an interior side view of a lock lever.

A lock lever 23 (FIG. 4) is pivotally mounted inside the resin case 19 by a lock shaft 22. The lock lever 23 is operatively connected to an inside lock button 24 and, as is known, displaceable between a locked position L (FIG. 1, 10 to 12) and an unlocked position U (FIG. 2). The lock lever 23 is held on either of the locked position L and the unlocked position U with a dead point D of an over center spring 25.

Figure 5:
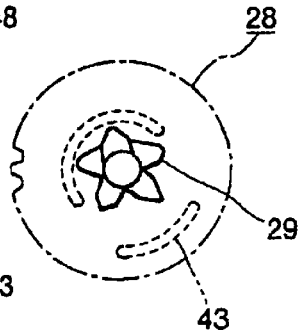
FIG. 5 is an interior side view of an output member.

A motor 26 for displacing the lock lever 23 to the locked position L and the unlocked position U is provided within the resin case 19. A cylindrical worm 27 fixed to a output shaft of the motor 26 is engaged with an output member or worm wheel 28 (FIG. 5). A gear wheel 29 having five gear teeth is fixed to the rotary shaft of the worm wheel 28, and is meshed with a geared portion 30 formed in the lock lever 23. The worm wheel 28 is kept at the neutral position by the elasticity of a returning spring (not shown) when the motor 26 is not energized, and it can be rotated both in the clockwise (locking) direction and in the counterclockwise (unlocking) direction from the neutral position by the power of the motor 26. The structure from the motor 26 to the geared portion 30 is described in detail in GB 2,357,548A, and therefore, here, it will simply be described below. In the state of FIG. 1, when the gear wheel 29 (worm wheel 28) rotates counterclockwise, the lock lever 23 is rotated clockwise to be displaced from the locked position L to the unlocked position U, and after that, even if the worm wheel 28 is rotated clockwise by the elasticity of the returning spring to be returned to the neutral position, the lock lever 23 is kept at the unlocked position U as it is. When the gear wheel 29 rotates clockwise from the neutral position by the motor power, the lock lever 23 is displaced from the unlocked position U to the locked position L, and after that, even if the worm wheel 38 is rotated counterclockwise by the elasticity of the returning spring to be returned to the neutral position, the lock lever 23 is kept at the locked position L as it is. Furthermore, when the worm wheel 28 is positioned at the neutral position, the rotation of the lock lever 23 is not transferred to the worm wheel 28.

Figure 6:
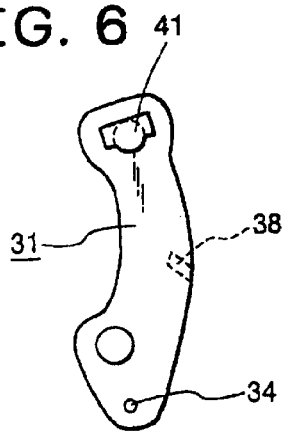
FIG. 6 is an interior side view of an intermediate lever.

An intermediate link 31 (FIG. 6) is provided between the open link 20 and the lock lever 23. The intermediate link 31 transmits the displacement of the lock lever 23 between the unlocked position U and the locked position L to the open link 20 in order to displace the open link 20 between the engaging position U' and the non-engaging position L'. The intermediate link 31 is pivotally mounted on the lock shaft 22. A main body portion of the intermediate link 31 is arranged in the interior side of the lock lever 23, and an anti-panic spring 32 is provided between the intermediate link 31 and the lock lever 23. A coil portion of the spring 32 is located around the lock shaft 22, and a first leg portion 32A of the spring is made to abut against a bent portion 33 of the lock lever 23, and a second leg portion 32B is engaged with a hole 34 of the intermediate link 31. The intermediate link 31 is urged to an unlocking direction (clockwise direction in FIG. 1) in relation to the lock lever 23 by the elastic force of the spring 32. The leg portion 32B of the embodiment is fitted to the intermediate link 31 via a through-hole 35 of the lock lever 23.

Figure 7:
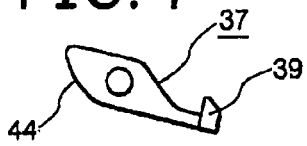
FIG. 7 is an interior side view of a connecting lever.

A connecting lever 37 (FIG. 7) is pivotally mounted on a pin 36 of the lock lever 23, and has a hook 39 engageable with a protrusion 38 formed on the exterior side of the intermediate link 31. The connecting lever 37 is urged by the elastic force of a connecting spring 40 in the counterclockwise direction in FIG. 2 about the pin 36 as a center, and the engagement between the protrusion 38 and the hook 39 are held by the elastic force of the connecting spring 40. In the normal state, the hook 39 and the protrusion 38 are held in the engaging state, and this engagement precludes the intermediate link 31 from being rotated clockwise by the elastic force of the anti-panic spring 32. However, when the connecting lever 37 is turned clockwise against the elastic force of the connecting spring 40, the hook 39 is disengaged from the protrusion 38 as shown in FIG. 11, so that the intermediate link 31 is displaceable in the unlocking direction by the elastic force of the anti-panic spring 32 independently from the lock lever 23 as shown in FIG. 12.

The intermediate link 31 is integrally provided with a pin portion 41 protruded into the interior side. The pin portion 41 is slidably engaged with a slot 42 of the open link 20. By the engagement with the pin portion 41 and the slot 42, the open link 20 displaces between the non-engaging position L' and the engaging position U' when the lock lever 23 (the intermediate link 31) displaces between the locked position L and the unlocked position U.

A cam body 43 is provided on the exterior side of the output member 28. The cam body 43 is adjacent to a contact portion 44 of the connecting lever 37 when the output member 28 is in the neutral position and the lock lever 23 is in the locked position L as shown in FIG. 10. When the output member 28 is rotated in the unlocking rotation (counterclockwise rotation) in the state of FIG. 10, the cam body 43 instantaneously comes into contact with abutting face 44 to turn the connecting lever 37 clockwise against the elastic force of the connecting spring 40, and the hook 39 of the connecting lever 37 is disengaged from the protrusion 38 of the intermediate link 31 as shown in FIG. 11. When the hook 39 is detached from the protrusion 38, the intermediate link 31 is displaced in the unlocking direction by the elastic force of the anti-panic spring 32 independently from the lock lever 23 (see FIG. 12), the open link 20 is then moved to the engaging position U' while the lock lever 23 is still on the lock position L. Note that, when the output member 28 is rotated in the locking direction (clockwise direction) from the neutral position, the cam body 43 is only separated from the abutting face 44.

The releasing of the engagement with the hook 39 and the protrusion 38 can be achieved only by a slight rotation of the output member 28 in the unlocking direction from the neutral position. At this time, though the lock lever 23 is rotated in the unlocking direction just slightly, it still does not come to cross over the dead point D of the over center spring 25. Therefore, if it is to be unlocked by the power of the motor 26, the open link 20 is displaced to the engaging position U' so that the door opening operation of the outside open handle 18 can be made effective before the lock lever 23 is switched into the unlocked position U.

Figure 8:
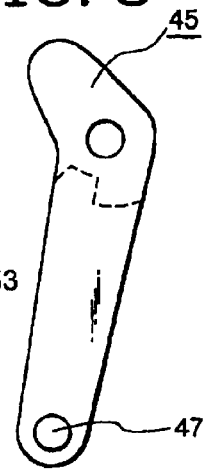
FIG. 8 is an interior side view of a sub lock lever.

A sub lock lever 45 (FIG. 8) is pivotally mounted inside the resin case 19. The sub lock lever 45 has a protrusion 47 engaged with a long hole 48 of the lock lever 23 and the sub lock lever 45 is constituted to displace integrally with the lock lever 23. A switch 49 for detecting the position of the lock lever 23 is provided near to the sub lock lever 45.

Figure 9:
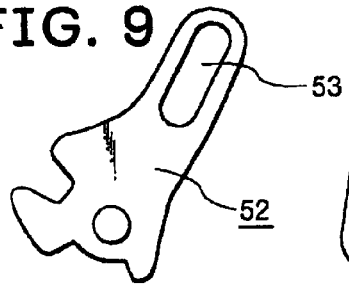
FIG. 9 is an interior side view of a switch lever.

A door key cylinder (not shown) is connected to a key lever 50 which has a protrusion 51 engaged with a long hole 53 of a switch lever 52 (FIG. 9). The switch lever 52 is connected to the sub lock lever 45 with a lost-motion, and a key operation detecting switch 54 is provided in the lateral side of the switch lever 52.

OPERATION

When the open lever 17 is rotated by the outside open handle 18 so as to move the open link 20 upward in the unlocked state, the abutting portion 21 of the open link 20 comes into contact with the ratchet pin 16, as shown in FIG. 2, to push it upward, thereby ratchet 14 is disengaged from the latch 13 to open the door.

When the locking operation of the inside lock button 24 and the like is performed in the unlocked state, the lock lever 23 is rotated counterclockwise and crosses over the dead point D of the over center spring 25 and moves upto the lock position L. Then, the intermediate link 31 connected to the lock lever 23 also displaces by the engagement with the protrusion 38 and the hook 39 of the connecting lever 37, so that the open link 20 turns counterclockwise and moves to the non-engaging position L', thereby the latch assembly becomes the locked state of FIG. 1.

In the locked state of FIGS. 1 and 10, when the open link 20 moves upward by the opening operation of the door handle 18, the abutting face 21 moves upward within the lateral side space of the ratchet pin 16 without abutting against the ratchet pin 16. In this state, when the lock lever 23 is subject to the unlocking operation, the intermediate link 31 and the open link 20 are turned clockwise. However, the abutting face 21 of the open link 20 immediately comes into contact with the side portion of the ratchet pin 16 in response to the clockwise rotation of the open link 20. Therefore, the subsequent clockwise rotation of the open link 20 become impossible, and it is not possible to shift the open link 20 from the non-engaging position L' to the engaging position U'. In this way, in the present embodiment, a state where the open link 20 is unable to displace from the non-engaging position L' to the engaging position U' because the abutting face 21 abuts against the side portion of the ratchet pin 16, becomes a panic state.

When plunged into the panic state, the open link 20 stays at the non-engaging position L' and is unable to turn clockwise. As a result, the intermediate lever 31 becomes also unable to turn clockwise. However, since the unlocking rotation of the lock lever 23 is transmitted to the intermediate lever 31 by the elastic force of the anti-panic spring 32, even when the intermediate lever 31 does not rotate, the lock lever 23 shifts to the unlocked position U, while compressing the anti-panic spring 32. Accordingly, after that, when the open handle 18 is released from the manipulation and the open link 20 is restored to the standby position from the actuated position and the abutting face 21 is moved lower than the ratchet pin 16, the intermediate lever 31 makes the clockwise rotation by the elastic force of the anti-panic spring 32 and the open link 20 also displaces from the non-engaging position L' to the engaging position U', so that the door latch device is put into the unlocked state and the door is opened by the second door opening operation.

In the locked state of FIGS. 1 and 10, when the unlocking operation is performed by the remote control, the switch of the central door lock, the smart entry mechanism and the like, the motor 26 is activated to rotate the output member 28 in the unlocking rotation (counterclockwise rotation). Then, by the engagement with the geared portion 30 and the gear wheel 29, the lock lever 23 gradually rotates clockwise against the elastic force of the over center spring 25. When the output member 28 rotates in the predetermined amount, the lock lever 23 reaches the dead point D and, when the lock lever 23 goes over the dead point D, the lock lever 23 moves upto the unlocked position U all at once by the elastic force of the over center spring 25.

In this way, when the motor 26 is activated by the remote control and the like, the lock lever 23 is unable to displace to the unlocked position U until the output member 28 rotates for the predetermined amount. From when the motor 26 is activated till the lock lever 23 displaces to the unlocked position U, some predetermined periods of time $\alpha$ are required. Conventionally, when the outside door handle 18 was manipulated before the predetermined periods of time $\alpha$ elapses, the above-described panic state occurred so that it was not possible to open the door.

On the contrary, in the present invention, when the motor 26 is activated by the remote control and the like to rotate the output member 28 in the unlocking direction (counterclockwise direction), the cam body 43 of the output member 28 immediately comes into contact with the abutting face 44 of the connecting lever 37 so as to turn the connecting lever 37 clockwise against the elastic force of the connecting spring 40, and the hook 39 of the connecting lever 37 is then disengaged from the protrusion 38 of the intermediate link 31 (See FIG. 11). When the hook 39 is detached from the protrusion 38, as shown in FIG. 12, the intermediate link 31 displaces in the unlocking direction by the elastic force of the anti-panic spring 32 independently from the movement of the lock lever 23, and the open link 20 is displaced to the engaging position U'. In this way, when the open link 20 moves to the engaging position U', the opening operation of the outside open handle 18 is made effective, and the ratchet pin 16 is pushed upward by the upper movement of the open link 20, thereby releasing the latch 13 from the ratchet 14 to open the door.

In the above description, the rotational amount of the output member 28 necessary to detach the hook 39 from the protrusion 38 can be made markedly small for the rotational amount necessary to shift the lock lever 23 to the unlocked position U. By moving the open link 20 to the engaging position U' without waiting for the displacement of the lock lever 23 to the unlocked position U, the substantial unlock of the door latch device can be realized in the early stage. Hence, in the present invention, the occurrence of the panic state due to the opening operation of the outside open handle 18 performed during the periods of time immediately after the operation of the motor 26 till the shifting of the lock lever 23 to the unlocked position U can be prevented and it is possible to reduce the occurrence itself of the panic state.

While the embodiment of the present invention has been descried as above, it can be modified without departing from the spirit and the scope of the invention. For example, the intermediate lever 31 pivoted on the lock lever 23 can be also pivoted on the open link 20. In this case, the anti-panic spring 32 is constituted such that the open link 20 is urged to the engaging position U' side in relative to the intermediate lever 31 so that a space between the intermediate lever 31 and the open link 20 is engaged by the connecting lever 37.

As described above, in the anti-panic mechanism according to the present invention, when the motor is activated by the remote control and the like so as to allow the output member 28 to make the unlocking rotation (counter-clockwise rotation), the open link 20 displaces to the engaging position U' without waiting for the displacement of the lock lever 23 to the unlocked position U so that the substantial unlock of the door latch device can be realized in the early stage and it is, therefore, possible to prevent the occurrence of the panic state due to the opening operation of the outside open handle 18 performed during the periods of time immediately after the operation of the motor 26 till the shifting of the lock lever 23 to the unlocked position U and reduce the occurrence itself of the panic state.

What is claimed is:

1. An anti-panic mechanism of a vehicle door latch device comprising:

a lock lever for connection to an inside lock button of a door and displaceable between an unlocked position and a locked position;

an over center spring urging the lock lever to either side of the unlocked position and locked position with a dead point thereof as a boundary;

an open link for connection to an outside open handle of the door, said open link displaceable from a standby position to an actuated position by an opening movement of the outside open handle, said open link displaceable between an engaging position in which the opening movement of the outside open handle is transmitted to a ratchet and a non-engaging position in which the opening movement of the outside open handle is not transmitted to the ratchet in response to the displacement of the lock lever to the unlocked position nad locked position;

an output member being rotated by power of a motor and displacing the lock lever to the unlocked position and locked position;

an anti-panic spring urging the open link toward the engaging position from the non-engaging position;

a connecting lever holding the open link in the non-engaging position against the elastic force of the anti-panic spring by engaging with te open link, said connecting lever disengaging from the open link by an unlocking rotation of the output member;

wherein said connecting lever is constituted so as to release the open link before the lock lever crosses over the dead point of the over, center spring when the output member us rotated in the unlocking direction to shift the lock lever to the unlocked position from the lock position.

2. The anti-panic mechanism of the vehicle door latch device according to claim 1, wherein the open link can continue to stay at the non-engaging position against the elastic force of the anti-panic spring when the lock lever is displaced from the locked position to the unlocked position.

3. The anti-panic mechanism of the vehicle door latch device according to claim 1, further comprising an intermediate link provided between the open link and the lock lever, said intermediate lick transmitting the displacement of the lock lever between the unlocked position and the locked position to the open link so as to displace the open link between the engaging position and the non-engaging position.

4. The anti-panic mechanism of the vehicle door latch device according to claim 3, wherein said intermediate lick is pivotally mounted on the lock lever.

5. The anti-panic mechanism of the vehicle door latch device according to claim 1, further comprising a connecting spring holding an engagement between the connecting lever and the open link, and a cam body provided on the output member, wherein said cam body comes into contact with the connecting lever to rotate the connecting lever against the elastic force of the connecting spring when the output member rotates in the unlocking direction from a neutral position.

* * * * *